US005258769A

United States Patent [19]

Knowles et al.

[11] Patent Number: 5,258,769

[45] Date of Patent: Nov. 2, 1993

[54] OMINIDIRECTIONAL GROUND PLANE EFFECT RADIATOR

[75] Inventors: Patrick J. Knowles, Laurel; Timothy G. Waterman, Eldersburg, both of Md.

[73] Assignee: Westinghouse Electric Corp., Pittsburgh, Pa.

[21] Appl. No.: 876,620

[22] Filed: Apr. 30, 1992

[51] Int. Cl.[5] ..... H01Q 9/38

[52] U.S. Cl. ..... 343/791; 343/720; 343/846

[58] Field of Search ..... 343/790, 791, 720, 829, 343/846, 878

[56] References Cited

U.S. PATENT DOCUMENTS 2,529,213 11/1950 Goldsmith ..... 343/790

*Primary Examiner*—Michael C. Wimer

*Attorney, Agent, or Firm*—D. Schron

[57] ABSTRACT

An antenna comprising a ground plane having a base portion and a cylindrical obstruction that extends from the base. The obstruction is oriented such that its longitudinal axis is perpendicular to the base ground plane. The antenna also has a conducting transmission along the length of the exterior of the obstruction. A feedpoint located near the base ground plane transmits a voltage signal between the transmission element and the exterior of the obstruction. A short circuit is provided between the transmission element and the obstruction at a point distal to the feedpoint.

6 Claims, 2 Drawing Sheets

FIG. 1
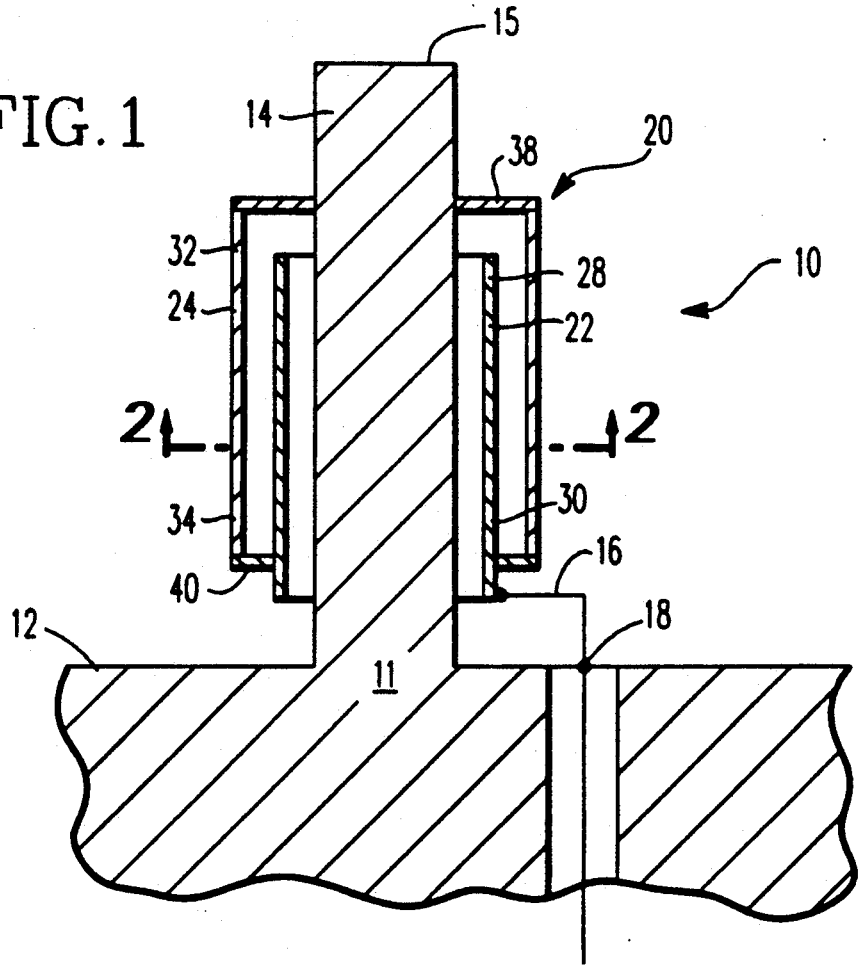
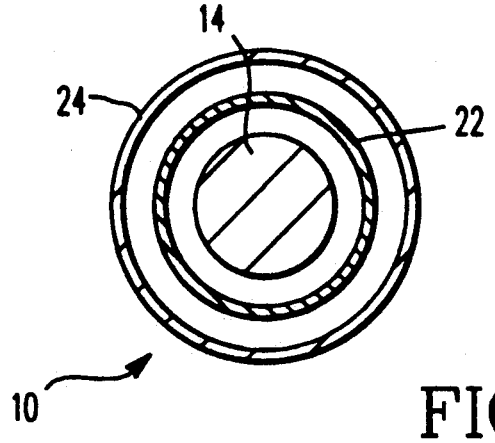
FIG. 2

OMINIDIRECTIONAL GROUND PLANE EFFECT RADIATOR

BACKGROUND OF THE INVENTION

1. Field of the Invention

This invention relates generally to antennas, and more particularly to antennas which seek to propagate a radiation pattern omnidirectionally in the azimuth plane and must do so proximate to an obstruction.

2. Description of the Prior Art

In monopole antennas, a conductive radiating element extends out perpendicularly to a ground plane. A generator or other voltage source then applies a voltage between the element and the ground plane. Due to space limitations, equipment must often be located near to the radiating element. An obstruction that is located within 0.05 wavelengths of the radiating element disrupts the propagation of radiation from the radiating element. This disruption of the radiation pattern occurs because the radiating element has more capacity to the obstruction than to free space. This causes a signal equal in magnitude to the signal being radiated from the radiating element to be generated at the obstruction. The signal generated at the obstruction is 180° out of phase to the radiated signal. Thus, the radiated signal is shorted at the monopole base which disrupts the projection of the radiation pattern. Practical space limitations often prevent moving the radiating element to an adequate distance away from the obstruction to prevent disruptive shorting of the signal.

SUMMARY OF THE INVENTION

We provide an omnidirectional ground plane effect radiator that uses a ground plane obstruction that extends from a base ground plane as an integral part of the radiating element. A transmission element is provided exterior to the obstruction capable of transmitting a uniform signal around the obstruction. Integrating a ground plane obstruction into the antenna eliminates the effects that such an obstruction would have on the radiation pattern of the antenna.

In a first preferred embodiment of the omnidirectional ground plane effect radiator, two coaxial cylindrical conducting elements are coaxially mounted exterior to a cylindrical obstruction so as to form a coaxial wave guide. An open circuit is provided near the feed point of the antenna and a short circuit is provided at some distance from the antenna feed point between the conducting elements and the ground plane obstruction.

In a second preferred embodiment of the omnidirectional ground plane effect radiator, four elongated sections of microstrip circuitry are mounted on corresponding sections of dielectric material which are mounted to the cylindrical obstruction. A short circuit is provided from each of the sections of microstrip circuitry to the ground plane obstruction at some distance from the antenna feed point. Each section of microstrip circuitry is spaced equally from adjacent sections of microstrip circuitry and the sections of microstrip circuitry are electrically connected to one another near the base ground plane.

BRIEF DESCRIPTION OF THE DRAWINGS

FIG. 1 is an elevational cross-sectional view of a first preferred embodiment of the omnidirectional ground plane effect radiator.

FIG. 2 is a sectional view taken along line 2—2 of FIG. 1.

DESCRIPTION OF THE PREFERRED EMBODIMENTS

Figure 3:
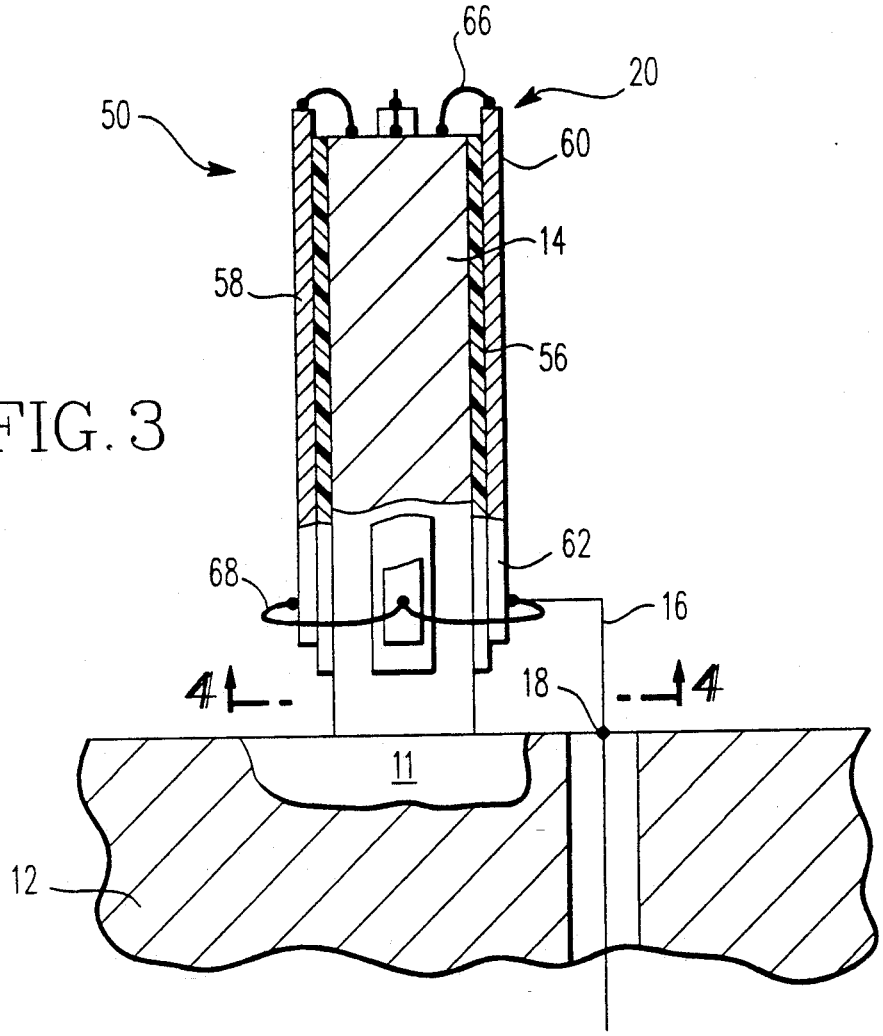
FIG. 3 is an elevational view partially in cross-section second preferred embodiment of the omnidirectional ground plane effect radiator.

The omnidirectional ground plane effect radiator incorporates, as part of an antenna apparatus, an obstruction 14 that extends from the base ground plane 12 and is located proximate to the intended location of the antenna. The obstruction 14 is first modified so as to be shaped cylindrically. Then, a transmission element 20 which can be microstrip circuitry, a coaxial waveguide or other suitable means is placed exterior to and around the obstruction 14. A signal is then introduced to the transmission element 20 from a feedpoint 18 located proximate to the base ground plane 12. A short is provided between the transmission element 20 and the obstruction 14 at some distance from the feedpoint 18. The omnidirectional ground plane effect radiator is designed to generate uniform, omnidirectional radiation pattern around the obstruction 14.

Referring first to FIGS. 1 and 2, a first preferred embodiment of the present omnidirectional ground plane effect radiator 10 (hereinafter referred to as "antenna") is shown. Antenna 10 is situated upon a base portion 12 of ground plane 11. An obstruction 14 extends out from the base portion 12 of ground plane 11. Obstruction 14 is a ground plane 11 that can be any piece of circuitry or equipment. The obstruction 14 is shaped cylindrically and extends outward from base ground plane 12 such that a longitudinal axis of obstruction 14 is perpendicular to the surface of base ground plane 12. The end of obstruction 14 that extends away from base ground plane 12 will be referred to as the upper end 15 of obstruction 14. A cylindrical outer conducting element 24 is coaxially mounted to the obstruction 14. Outer conducting element 24 has a diameter that is greater than the diameter of the obstruction 14 by a predetermined amount. Thus, outer conducting element 24 is mounted exterior to the obstruction 14. Outer conducting element 24 is made of a material having good electrical conductivity such as copper or aluminum.

The outer conducting element 24 has an upper end 32 and a lower end 34 located opposite to one another along the longitudinal axis of outer conducting element 24. The outer conducting element upper end 32 is the end of outer conducting element 24 that is located farthest from base ground plane 12. Outer conducting element 24 also has a lower end 34 located proximate to the base ground plane 12. Outer conducting element 24 is mounted to obstruction 14 by an annular shorting connection 38. Shorting connection 38 circumferentially connects outer conducting element upper end 32 to obstruction upper end 15. The circumference of the cylindrical outer conducting element 24 is designed to be less than one wavelength of the operating signal. If the outer conducting elements circumference exceeds one wavelength, nulls (points of zero voltage) will develop around the element, as will points of concentrated voltage. This is because more than one mode is being supported around the element. This condition is called moding. Moding decreases to an acceptable level when the conducting element circumference is designed so as to be less than one wavelength and becomes practically nonexistent at much smaller circumferences as is preferred.

A cylindrical inner conducting element 22 is coaxially positioned between obstruction 14 and outer conducting element 24. Inner conducting element 22 has a diameter that is greater than the diameter of the obstruction 14. Inner conducting element 22 is thus positioned exterior to obstruction 14. The diameters of the inner conducting element 22 and the obstruction 14 are designed so that inner conducting element 22 is separated by some distance from obstruction 14. Inner conducting element 22 further has a diameter that is less than the diameter of the outer conducting element 24, therefore, inner conducting element 22 is positioned coaxially between obstruction 14 and outer conducting element 24.

The diameters of the inner conducting element 22 and the outer conducting element 24 are designed so that inner conducting element 22 is separated by some distance from outer conducting element 24.

Inner conducting element 22 is made of a material having good electrical conductivity such as copper or aluminum. The inner conducting element 22 has an upper end 28 and a lower end 30 located opposite to one another along the longitudinal axis of outer conducting element 22. Inner conducting element 22 has a lower end 30 that is proximate to base ground plane 12. Inner conducting element 22 also has an upper end 28 that is located distal to base ground plane 12. Inner conducting element 22 is connected to outer conducting element 24 by annular element connection 40. Element connection 40 is made of a conductive material and circumferentially connects inner conducting element lower end 30 to outer conducting element lower end 34.

Thus, antenna 10 is formed from three coaxial cylindrical components. These components are obstruction 14 and transmission element 20 which is comprised of inner cylindrical conducting element 22 and outer cylindrical conducting element 24. The three cylindrical components 14, 22, 24 cooperate to act as a waveguide for the fed signal. In this embodiment, an open circuit is preferably located proximate to feed point 18.

In operation, a voltage signal is applied at a feed point 18 which travels across line 16 to inner conducting element lower end 30. Thus, a signal travels between obstruction 14 and inner conducting element 22. The signal travels toward shorting connection 38 which is a short circuit. As the signal meets the short circuit, a standing wave is formed. The signal then travels between inner conducting element 22 and outer conducting element 24. An open circuit (not shown) is located proximate to feed point 18 which presents the current from flowing up the inside of the cylinder.

Figure 4:
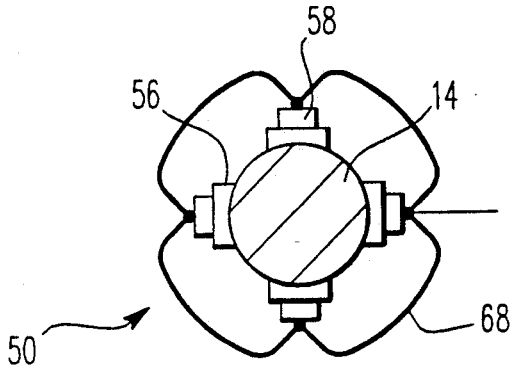
FIG. 4 is a sectional view taken along line 4—4 of FIG. 3.

Referring next to FIGS. 3 and 4, a second preferred embodiment of the present omnidirectional ground plane effect radiator 50 (hereinafter referred to as "radiator") is shown. Radiator 50 is situated upon a base ground plane 12. An obstruction 14 of ground plane 11 extends outward from the base ground plane 12 such that a longitudinal axis of obstruction 14 is perpendicular to the surface of base ground plane 12. The obstruction 14 has an upper end 15 that extends away from base ground plane 12. In this embodiment, transmission element 20 is comprised of microstrip circuitry 58.

Four elongated strips of dielectric material 56 are mounted longitudinally to the surface of obstruction 14. Dielectric strips 56 are mounted so as to be parallel to one another and parallel to the longitudinal axis of the obstruction 14. The dielectric strips 56 are spaced along the surface of obstruction 14 such that the distance between any two adjacent dielectric strips 56 is the same as the distance between any other two adjacent dielectric strips 56. The preferred material of dielectric strip 56 is a low loss material such as polytetrafluoroethylene, known as Teflon®.

An elongated section of microstrip circuitry 58 is mounted upon each dielectric strip 56 so that microstrip circuitry sections 58 are electrically insulated from obstruction 14. The microstrip circuitry sections 58 are mounted so as to be parallel to one another and to be parallel to the longitudinal axis of the obstruction 14. The dielectric strips 56 are spaced so that the spacing between any two adjacent sections 58 is equal. The microstrip circuitry sections 58 each have an upper end 60 that is distal to base ground plane 12. The microstrip circuitry sections 58 also each have a lower end 62 that is located near to base ground plane 12. The upper ends 60 of each microstrip circuitry section 58 are connected to obstruction 14 by an electrically conducting shorting connection 66.

The lower ends 62 of each microstrip circuitry section 58 are connected to one another by an electrically conductive microstrip connection 68. Microstrip connection 68 connects each microstrip section 58 together so that the connection has a generally circumferential path around obstruction 14 as seen best in FIG. 4. Thus, microstrip connection 68 is seen to have an approximate circumference. The circumference of the microstrip connection 68 is designed to be less than one wavelength of the operating signal, and preferably less than one half wavelength of the operating signal to prevent moding.

In operation, a voltage signal is applied at feed point 18 which travels along line 16 to the microstrip circuitry lower ends 62. The signal travels across microstrip connections 68 so that a signal is propagated through microstrip circuitry sections 58 and towards shorting connection 66 which is a short circuit. As the signal meets the short circuit, a standing wave is formed. Thus, the signal reflects and looks like an open circuit at point 18.

Variations of the preferred embodiments could be made. For example, although in both of the preferred embodiments the antenna is shown to be oriented vertically and extending out from a horizontally oriented base ground plane 12, it is possible for the antenna and base ground plane 12 to be oriented in any direction so long as the antenna and base ground plane 12 are perpendicular to one another.

Also, in the second preferred embodiment, although four strips of dielectric material and four sections of microstrip circuitry are shown mounted to the obstruction, any number of strips and sections greater than two may be used.

Also, although the first preferred embodiment incorporates cylindrical conducting elements having circular cross-sections, other cross-sectional shapes such as square, hexagonal or octagonal may be used.

While certain present preferred embodiments have been shown and described, it is distinctly understood that the invention is not limited thereto but may be otherwise embodied within the scope of the following claims.

We claim:

1. An antenna comprising, (a) a ground plane having a base and a cylindrical obstruction that extends from the base such that a longitudinal axis of the obstruction is perpendicular to the base ground plane, the obstruction having an upper end that is longitudinally distal to the base ground plane;

(b) an elongated conducting transmission assembly that lies circumferentially around and extends along the length of the exterior of the obstruction, the transmission assembly transmits a voltage signal along the exterior of the obstruction from a feed point proximate to the base ground plane to the obstruction upper end, wherein a shirt circuit connects the transmission assembly to the obstruction at a point distal to the feed point, wherein the transmission assembly is a cylindrical outer conducting element mounted exterior to and coaxial with the obstruction and a cylindrical inner conducting element, the inner conducting element being mounted exterior to and coaxial with the obstruction and positioned between the obstruction and the outer conducting element, the inner conducting element being separated by a selected distance from the obstruction and a selected distance from the outer conducting element, each cylindrical conducting element having a lower end that is proximate to the base ground plane and each having an upper end that is distal to the base ground plane, the lower end of the outer conducting element being connected to the lower end of the inner conducting element and the upper end of the outer conducting element being connected to the upper end of the obstruction.

2. The antenna of claim 1 wherein the outer conducting element has a circumference that is less than one wavelength.

3. An antenna comprising, (a) a ground plane having a base and a cylindrical obstruction that extends from the base such that a longitudinal axis of the obstruction is perpendicular to the base ground plane, the obstruction having an upper end that is longitudinally distal to the base ground plane;

(b) an elongated conducting transmission assembly that lies circumferentially around and extends along the length of the exterior of the obstruction, the transmission assembly transmits a voltage signal along the exterior of the obstruction from a feed point proximate to the base ground plane to the obstruction upper end, wherein a short circuit connects the transmission assembly to the obstruction at a point distal to the feed point, wherein the transmission assembly is at least two elongated sections of microstrip circuitry each being mounted to a corresponding strip of dielectric material which in turn is mounted to the exterior of the obstruction, the microstrip circuitry being mounted parallel to one another and each being parallel to the longitudinal axis of the obstruction, each adjacent pair of microstrip circuitry sections being spaced equally apart circumferentially, each microstrip circuitry section further being connected to one another at a point on the microstrip circuitry proximate to the base ground plane.

4. The antenna of claim 3 having four sections of microstrip circuitry.

5. An antenna comprising, (a) a ground plane having a base and a cylindrical obstruction that extends from the base ground plane such that a longitudinal axis of the obstruction is perpendicular to the base ground plane, the obstruction having an upper end that is longitudinally distal to the base ground plane;

(b) a cylindrical outer conducting element, mounted exterior to and coaxial with the obstruction, the outer conducting element having an upper end and a lower end, so that the outer conducting element lower end is proximate to the base ground plane and the outer conducting element upper end is distal to the base ground plane;

(c) a cylindrical inner conducting element, mounted exterior to and coaxial with the obstruction and positioned between the obstruction and the outer conducting element, the inner conducting element being separated by a selected distance from the outer conducting element and the obstruction, the inner conducting element having an upper end and a lower end so that the inner conducting element lower end is proximate to the base ground plane and the outer conducting element upper end is distal to the base ground plane, wherein the outer conducting element lower end is connected to the inner conducting element lower end by an element connection, and the outer conducting element upper end is connected to the upper end of obstruction by a shorting connection; and (d) a means for applying a voltage signal at the lower end of the inner conducting element.

6. An antenna comprising, (a) a ground plane having a base and a cylindrical obstruction that extends from the base ground plane such that a longitudinal axis of the obstruction is perpendicular to the base ground plane, the obstruction having an upper end that is longitudinally distal to the base ground plane, and the obstruction further having continuous cylindrical sides extending from the base ground plane to the obstruction upper end;

(b) at least two elongated strips of dielectric material mounted to the sides of the obstruction, the dielectric strips being mounted parallel to one another and each being parallel to the longitudinal axis of the obstruction, each adjacent pair of dielectric strips further being spaced equally apart;

(c) at least two elongated sections of microstrip circuitry, one each of the microstrip circuitry, one each of the microstrip circuitry sections being mounted to a corresponding dielectric strip, the microstrip circuitry sections being mounted parallel to one another and each being parallel to the longitudinal axis of the obstruction, each adjacent pair of microstrip circuitry sections being spaced equally apart, the microstrip circuitry sections each having an upper end and a lower end so that the microstrip circuitry section lower end is proximate to the base ground plane and the microstrip circuitry section upper end is distal to the base ground plane, wherein the microstrip circuitry section lower ends are connected by a microstrip connection, and the microstrip circuitry section upper ends are connected to the obstruction upper end by a shorting connection; and (d) a means for applying a voltage signal at the lower end of the microstrip circuitry sections.

* * * * *